US006802090B2

(12) United States Patent
Martin

(10) Patent No.: US 6,802,090 B2
(45) Date of Patent: Oct. 12, 2004

(54) LAVATORY-TOILET COMBINATION

(76) Inventor: Vicki Lee Martin, 4028 S. 850 W., Riverdale, UT (US) 84405

( * ) Notice: Subject to any disclaimer, the term of this patent is extended or adjusted under 35 U.S.C. 154(b) by 0 days.

(21) Appl. No.: 10/082,410

(22) Filed: Sep. 18, 2002

(65) Prior Publication Data

US 2003/0046759 A1 Mar. 13, 2003

Related U.S. Application Data

(60) Provisional application No. 60/269,928, filed on Feb. 21, 2001.

(51) Int. Cl.[7] ..... A47K 4/00; E03C 1/01

(52) U.S. Cl. ..... 4/665; 4/619

(58) Field of Search ..... 4/619, 665; 137/562

(56) References Cited

U.S. PATENT DOCUMENTS 1,287,247 A * 12/1918 Cross ..... 4/668
2,595,009 A * 4/1952 Sillen ..... 4/665
2,651,051 A * 9/1953 Parks et al. ..... 137/625.44
2,860,348 A * 11/1958 McClenahan ..... 4/665
5,210,886 A * 5/1993 Coe, III ..... 4/665

FOREIGN PATENT DOCUMENTS

DE 3705044 * 9/1988 ..... 4/665

* cited by examiner

*Primary Examiner*—Charles E. Phillips

(57) ABSTRACT

This lavatory-toilet combination allows the user to immediately recycle hand and other lavatory sink water to flush the toilet or to drain in the traditional manner. Besides choosing flush or drain, the user chooses the amount of water over 1.6 gallons and the temperature of that water. This combination eliminates the toilet tank with it's many parts needing repair and replacement.

REFERENCES

| | | |
|---|---|---|
| 1,935,779 | 21 Nov. 1933 | Kemach |
| 2,860,348 | 18 Nov. 1958 | McClenahan |
| 3,588,922 | 29 Jun. 1971 | Carfora |
| 3,995,327 | 7 Dec. 1976 | Hendrick |
| 5,228,152 | 20 Jul. 1993 | Fraley |
| 5,522,096 | 4 Jun. 1996 | Brown |

9 Claims, 2 Drawing Sheets

LAVATORY-TOILET COMBINATION

This application claims the benefit of provisional application Ser. No. 60/269,928 filed Feb. 21, 2001.

BACKGROUND

1. Field of the Invention

This invention relates to lavatories and toilets, specifically with regard to combining the two with the options of choosing the temperature of flush water and whether to flush or to drain the lavatory water.

BACKGROUND

2. Description of the Prior Art

Toilets now in use have attached water tanks holding fresh, potable water to flush waste from the toilet bowl. Toilet tanks have several inner parts to automatically re-fill the tank in preparation for the next flush. Although convenient in use, present toilet tanks offer no choice in the amount of water to flush and always require fresh drinkable water for flushing.

Several patents address the idea of re-cycling hand wash water to toilet flush. Carfora (U.S. Pat. No. 3,588,922) designed a lavatory bowl mounted in place of the flush tank lid. The combinations in Brown (U.S. Pat. No. 5,522,096), Fraley (U.S. Pat. No. 5,228,152), and Kemach (U.S. Pat. No. 1,935,779) indicate hand wash basins above traditional toilet tanks. None gives choices in the amount of water to flush, nor whether to flush or to drain. Hendrick (U.S. Pat. No. 3,995,327) designed a system sending lavatory water from one room to the next. This seems feasible in public restrooms where the two sanitary functions are often performed in separate rooms. His design, with the usual tank, does not permit the user to directly use the entire system to flush or drain, to choose the amount of water in flushing, or to flush with hot or cold water. McClenahan (U.S. Pat. No. 2,860,348) designed a streamlines combination requiring all sink water to exit flushing the toilet. The user had no choice but to flush. All prior inventions except Hendrich place the lavatory sink above the toilet. Although this saves space, the extra height can make it difficult for children and smaller adults to use. All previous inventions except McClenahan retain the toilet tank with it's many parts requiring repair and replacement. Only McClenahan give the user choice in the amount of water and the temperature of that water to flush. None of the previous inventions gives the user a choice in whether to flush or to drain.

OBJECTS AND ADVANTAGES

Therefore, besides the advantages and objects of the lavatory-toilet described in my above patent, several objects and advantages of my present invention are:

(a) to provide a method of immediately recycling "gray water" into flush water.

(b) to provide a means for sanitizing toilet bowls with hot water.

(c) to eliminate the many parts of the toilet tank requiring repair and replacement.

(d) to eliminate the attraction to small children of standing water in the toilet bowl.

(e) To provide a water and space conservative bathroom fixture.

DRAWING FIGURES

There are three drawings.

REFERENCE NUMERALS IN DRAWINGS

| | |
|---|---|
| 1 | drain handle for water plug |
| 2 | water handles |
| 3 | faucet |
| 4 | lavatory basin |
| 5 | measurement ridge |
| 6 | drain flush handle |
| 7 | connector |
| 8 | drain flush flap |
| 9 | flush flap lip |
| 10 | lavatory drain |
| 11 | flushway |
| 12 | toilet bowl |

SUMMARY OF THE INVENTION

The Present toilet-lavatory invention simplifies the design and eliminates the problems of previous inventions. It installs as easily as the traditional separate toilet and lavatory and requires no extra plumbing. It eliminates the toilet tank with it's many parts to be repaired and replaced. It provides hot and cold running water for hand washing and other sink functions which can then be routed either to flush the toilet or to drain as "gray water" and possibly be reused as horticultural irrigation. When the user decides to flush, the amount of water in excess of 1.6 gallons and the temperature of that water are determined by the user. Hot flushes sanitize the toilet bowl better than cold. Also since the toilet bowl is essentially emptied at the time of flushing, small children will not be tempted to play in the toilet bowl water. Further objects and advantages of my invention will become apparent from a consideration of the drawings and ensuing description.

DESCRIPTION OF THE PREFERRED EMBODIMENT

Figure 1:
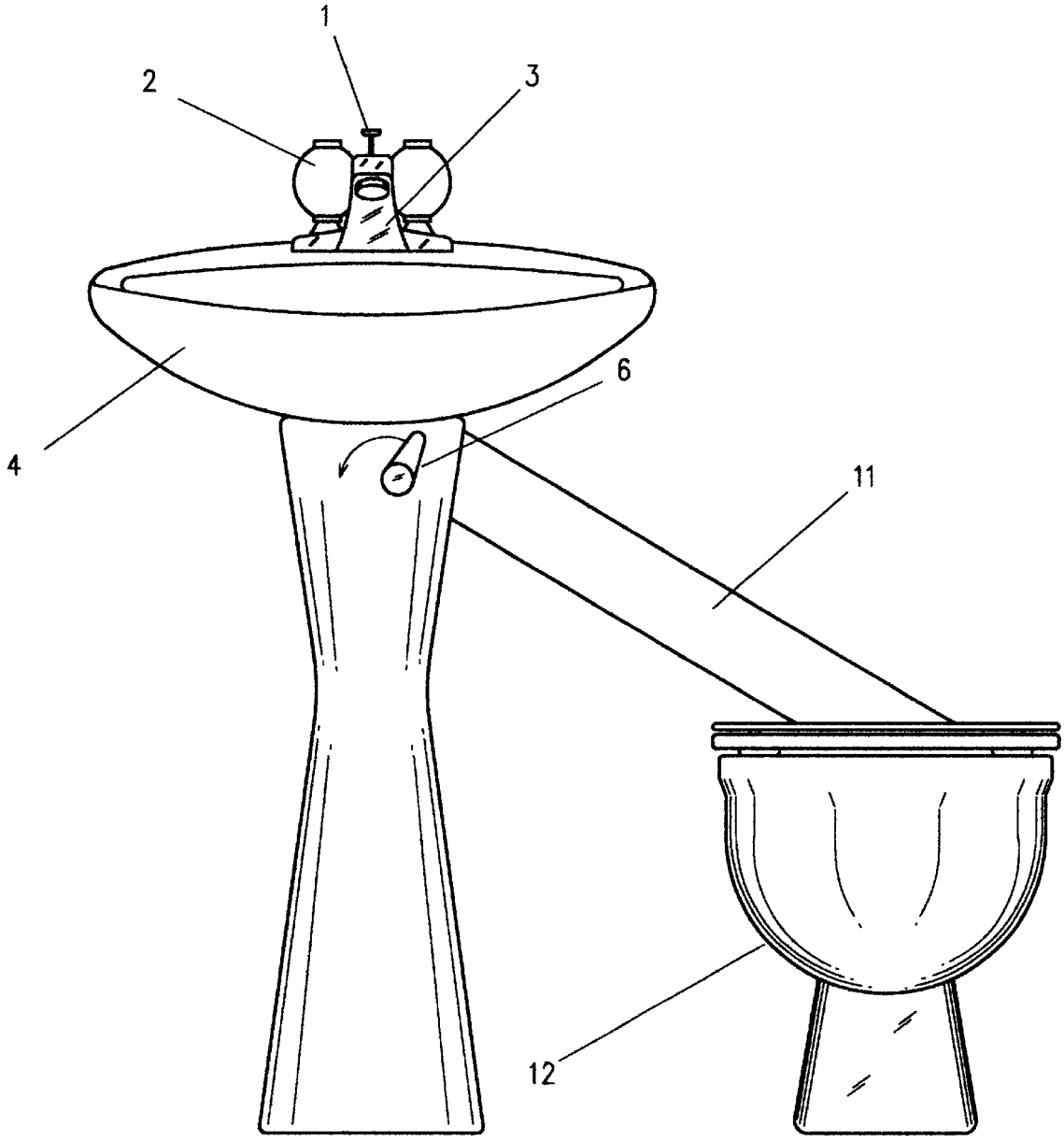
FIG. 1 shows the entire fixture from the front prospective.
Figure 2:
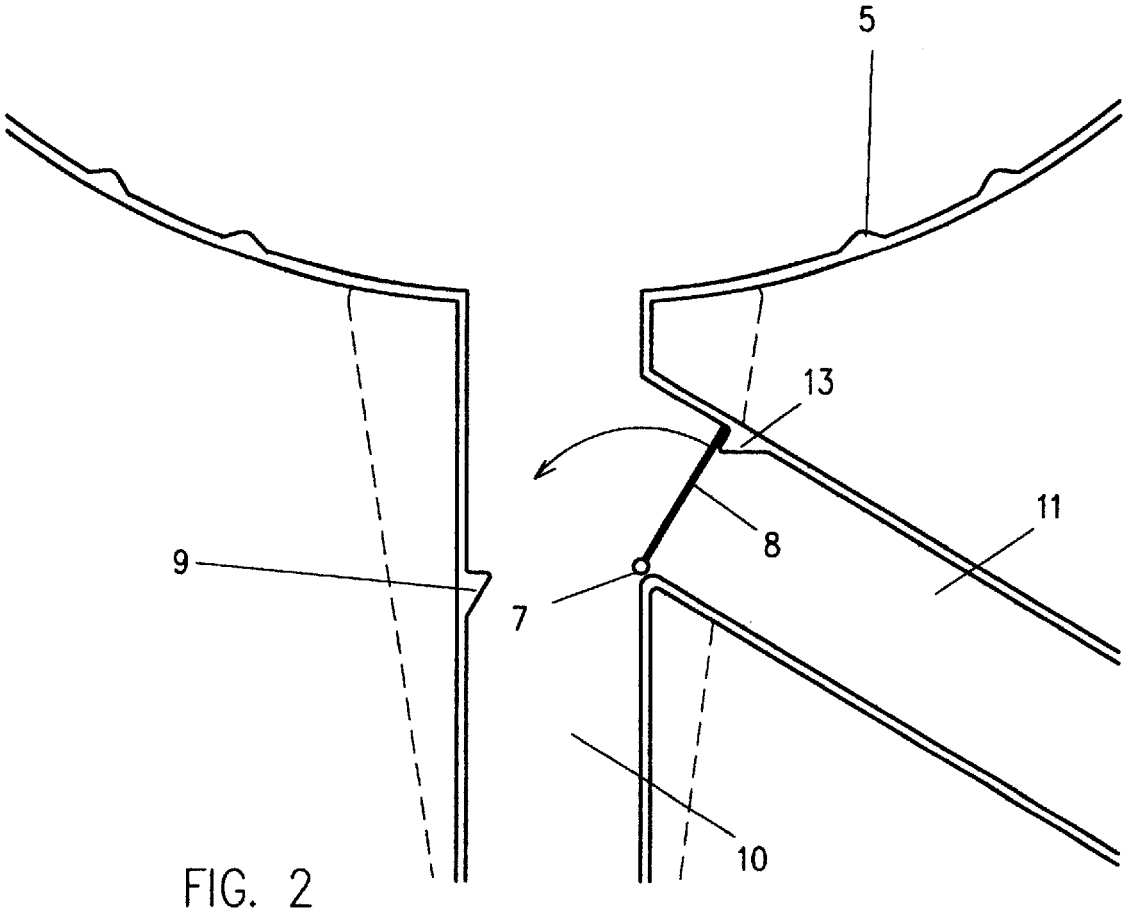
FIG. 2 shows the internal workings of the drain-flush intersection.
Figure 3:
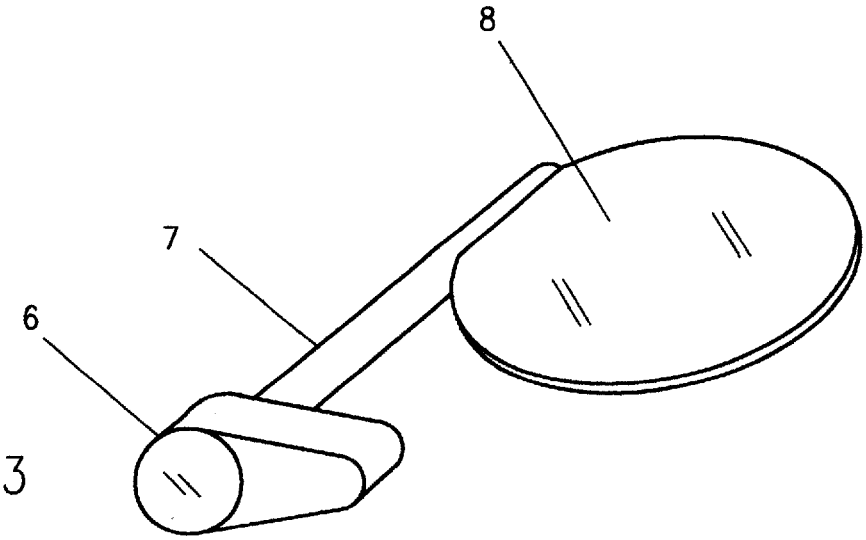
FIG. 3 shows the drain flush flap mechanism.

The lavatory bowl is the traditional design with one small modification of amount ridges. FIG. 1 shows the entire fixture. The drain handle for the water plug 1 is depressed to hold water in the lavatory basin 4. The water handles 2 are twisted in the usual fashion to bring water through the faucet 3. As water gushes into said lavatory basin, the user can monitor the amount of water rising against the ridges 5 indicating each ¼ gallon increment except for the 1.6 gallon level (instead of 1.5 gallon). The top water ridge indicates a 2.5 gallon capacity. The drain-flushway intersection at the front of the fixture has few parts simply connected. The drain flush handle 6 is located at the juncture of the lavatory drain 10 and the flushway 11. The point of said drain flush handle reflects-the position of the drain flush flap 8 indicating whether the fixture is in flush mode or drain mode. This triangular handle is easily used at the front of the fixture. Drain flush handle is connected by the connector 7 through pedestal drain to drain flush flap. When the flap is positioned against the flush flap lip 9 water draining from lavatory basin is shunted to said flushway to flush the toilet bowl 12. When said flap rests against the drain setback 13 the water leaving said lavatory basin is channeled directly downward in the traditional method through lavatory drain. Toilet bowl and the toilet seat 12 are the traditional design.

The preferred material is vitreous china but it could be made of wood; plastic; metal; soy, or other vegetable compound; or any other strong and rigid material resistant to rust and able to support the weight of an adult human being.

I claim:

1. A low maintenance lavatory basin and toilet bowl combination comprising: a tank free toilet bowl, a lavatory basin in adjacent proximity to said toilet bowl, a drain conduit enabling lavatory water to drain to a sewer or to said toilet bowl, a flush conduit sending said lavatory water to the toilet bowl, and a means for controllably diverting said lavatory water from a path to the sewer to a path to the toilet bowl and vice versa, said lavatory basin including a bowl and a drain opening, said lavatory basin including a plurality of ridges spaced incrementally between said drain opening and a top of said basin, each ridge indicating a predetermined quantity of water volumn when water resides at one of said plurality of ridges such that a user upon observation can determine and control the amount of water in the lavatory bowl to be directed to flush said toilet bowl.

2. The lavatory-toilet of claim 1 wherein said means for diverting said lavatory water is a manually operated flap.

3. The lavatory-toilet of claim 1 wherein said lavatory-toilet is composed of concrete.

4. The lavatory-toilet of claim 1 wherein said lavatory-toilet is child height.

5. The lavatory-toilet of claim 1 wherein said lavatory-toilet is composed of china.

6. The lavatory-toilet of claim 1 wherein said lavatory-toilet is composed of composite vegetable material.

7. The lavatory-toilet of claim 1 Wherein said lavatory-toilet is composed of metal.

8. The lavatory-toilet of claim 1 wherein said lavatory-toilet is composed of plastic.

9. The lavatory-toilet of claim 1 wherein said lavatory-toilet is composed of fiberglass.

* * * * *